US009184032B1

(12) United States Patent
Bowen et al.

(10) Patent No.: US 9,184,032 B1
(45) Date of Patent: Nov. 10, 2015

(54) PERFORMANCE REGULATED IMAGE INTENSIFIER POWER SUPPLY

(71) Applicant: EXELIS, INC., McLean, VA (US)

(72) Inventors: James Hoge Bowen, Salem, VA (US); Ransom Hal Castleberry, Blacksburg, VA (US); William Eric Garris, Salem, VA (US)

(73) Assignee: Exelis, Inc., Herndon, VA (US)

( * ) Notice: Subject to any disclaimer, the term of this patent is extended or adjusted under 35 U.S.C. 154(b) by 325 days.

(21) Appl. No.: 13/786,878

(22) Filed: Mar. 6, 2013

(51) Int. Cl.
*H01J 40/14* (2006.01)

(52) U.S. Cl.
CPC ..... *H01J 40/14* (2013.01)

(58) Field of Classification Search
CPC ..... G02B 23/12; G09G 1/04; H04N 5/2357; H04N 5/45
USPC ..... 250/208.1; 348/216.1, 217.1
See application file for complete search history.

(56) References Cited

U.S. PATENT DOCUMENTS

| | | | | |
|---|---|---|---|---|
| 6,320,180 | B1 | 11/2001 | Estrera et al. | |
| 6,429,416 | B1 | 8/2002 | Porter | |
| 7,109,467 | B2 | 9/2006 | Kominsky et al. | |
| 7,141,777 | B1 | 11/2006 | Brillhart | |
| 2008/0099662 | A1 * | 5/2008 | Musiel et al. | 250/205 |
| 2009/0072749 | A1 | 3/2009 | Saldana | |

* cited by examiner

*Primary Examiner* — Twyler Haskins
*Assistant Examiner* — Padma Haliyur
(74) *Attorney, Agent, or Firm* — RatnerPrestia

(57) ABSTRACT

Power supplies and methods for regulating performance of image intensifiers are disclosed. Performance is regulated by controlling the duty factor of the image intensifiers.

15 Claims, 4 Drawing Sheets

PERFORMANCE REGULATED IMAGE INTENSIFIER POWER SUPPLY

FIELD OF THE INVENTION

The present invention relates to image intensifiers and, more particularly, to methods and apparatus for controlling the power supply of an image intensifier to regulate performance.

BACKGROUND OF THE INVENTION

Image intensifiers are well known for their ability to enhance night-time vision. An image intensifier amplifies the incident light received by it to produce a signal that is bright enough for detection by the eyes of a viewer. These devices, which are particularly useful for providing images from dark regions, have both industrial and military application. The U.S. military uses image intensifiers during night-time operations for viewing and aiming at targets that otherwise would not be visible. Low intensity visible spectrum radiation and near-infrared radiation is reflected from a target, and the reflected energy is amplified by the image intensifier. As a result, the target is made visible without the use of additional light. Other examples include using image intensifiers for enhancing the night vision of aviators, for providing night vision to sufferers of retinitis pigmentosa (night blindness), and for photographing astronomical bodies.

FIG. 1 depicts an exemplary image intensifier 10. The image intensifier 10 includes an objective lens 12 that focuses visible and infrared radiation (collectively referred to herein as light) from a distant object onto a photocathode 14. The photocathode 14, e.g., a photoemissive semiconductor heterostructure that is extremely sensitive to low-radiation levels of light in the 580-900 nm spectral range, provides a spatially coherent emission of electrons in response to the electromagnetic radiation. Electrons emitted from the photocathode 14 are accelerated towards an input plane of a micro-channel plate (MCP) 20. The MCP 20 amplifies the incident electrons in a spatially coherent manner. Electrons emerging from an output plane of the MCP 20 are accelerated toward a phosphor screen 16 (anode), which is maintained at a higher positive potential than the output of the MCP 20. The phosphor screen 16 converts the emitted electrons into visible light. An operator may view the visible light image provided by the phosphor screen through an eyepiece 18.

Conventional MCPs 20 include a thin glass plate having an array of microscopic holes through it used to increase the density of the electron emission from the photocathode 14. Electrons impinging on interior sides of the holes through the MCP 20 result in the emission of a number of secondary electrons each of which, in turn, causes the emission of more secondary electrons. Thus, each microscopic hole acts as a channel-type secondary emission electron multiplier having a gain of up to, for example, ten thousand. The electron gain of the MCP 20 is controlled primarily by the potential difference between its input and output planes. A power source 22 applies power to the photocathode 14, the MCP 20, and the phosphor screen 16.

Image intensifiers for use in night vision systems commonly use a measurement called Figure of Merit (FOM) for image quality. FOM is the arithmetic product of the resolution, measured in line pairs per millimeter (lp/mm) and signal-to-noise ratio (SNR), which is unitless. Resolution typically varies in the range of 50 to 72 lp/mm. SNR typically varies in the range of 20 to 25. So FOM typically varies in the range of 1,000 to 1,800, with a higher FOM generally representing a superior overall image quality. FOM may be important in some contexts because the United States government regulates the export of night vision systems by requiring that exported items have a FOM below a specified threshold. Accordingly, methods and apparatus of regulating FOM of an image intensifier are useful.

SUMMARY OF THE INVENTION

Aspects of the present invention are embodied in methods and apparatus for regulating performance of image intensifiers. Performance is regulated by, inter alia, controlling the duty factor of the image intensifiers.

BRIEF DESCRIPTION OF THE DRAWINGS

The invention is best understood from the following detailed description when read in connection with the accompanying drawings, with like elements having the same reference numerals. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
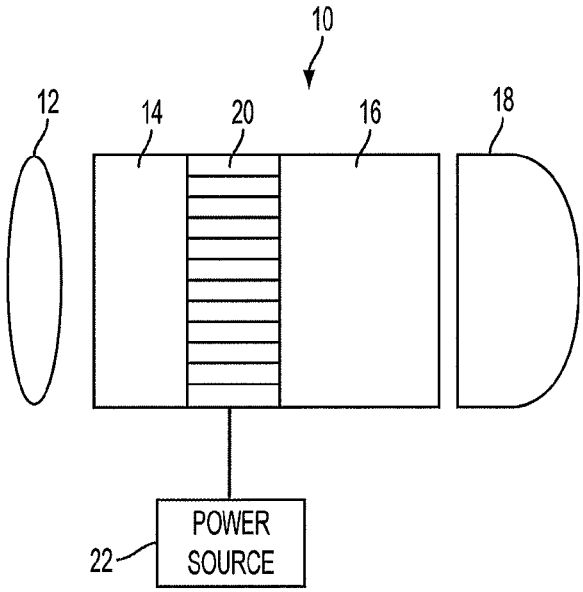
FIG. 1 PRIOR ART
FIG. 1 depicts an image intensifier in accordance with the prior art.
Figure 2:
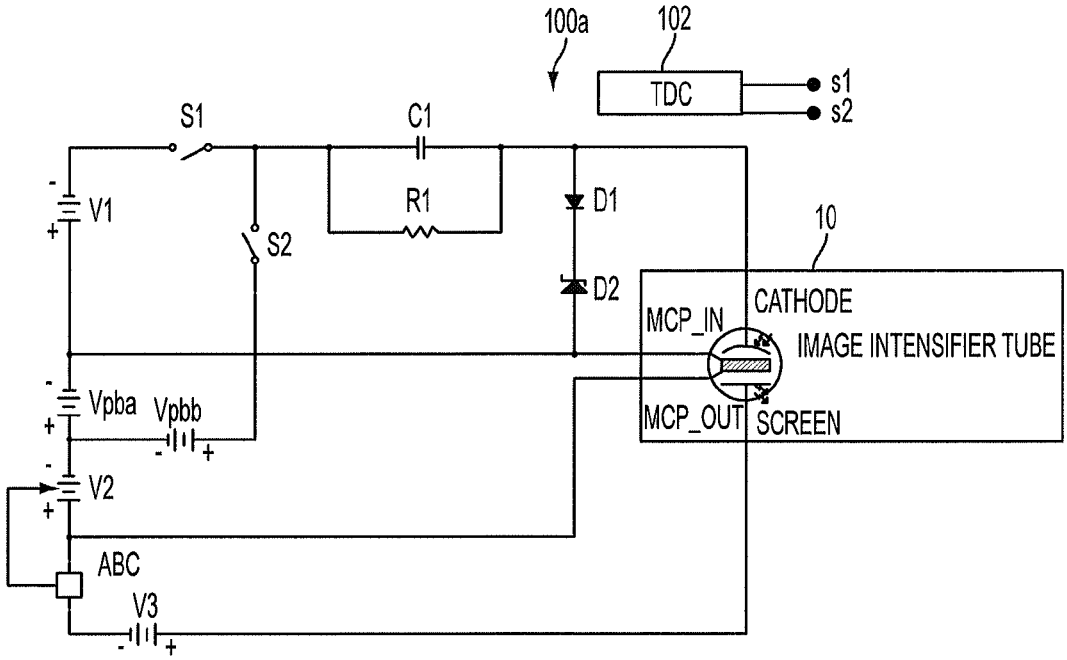
FIG. 2 depicts a power supply for use with an image intensifier in accordance with aspects of the present invention.

FIG. 2 depicts a power supply 100*a* for use with an image intensifier 10, such as that shown in FIG. 1, in accordance with aspects of the present invention. Power supply 100*a* includes three primary voltage sources, referenced as first, second, and third voltage source (V1, V2, and V3, respectively), coupled in series. A positive terminal of the third voltage source V3 is coupled to the phosphor screen 16 and applies a positive voltage to the phosphor screen 16, e.g., on the order of +4000 to +6000 volts DC. A positive terminal of the second voltage source V2 is coupled to an output plane of MCP 20 and a negative terminal of the second voltage source V2 is coupled to an input plane of MCP 20. The voltage applied by the second voltage source V2 across the MCP 20 may be on the order of −800 to −1100 volts DC. A negative terminal of the first voltage source V1 is coupled to the photocathode 14, is negative with respect to the second voltage source V2, and may be on the order of −600 volts DC relative to the second voltage source V2. It is understood that the values provided for the primary voltage sources are exemplary, and may vary in different embodiments.

Illustrated power supply 100*a* further includes two secondary voltage sources, referenced as Vpba and Vpbb. Either one of the secondary voltage sources, Vpba and Vpbb, may be optionally used to provide positive bias so that the photocathode is turned off during the time that a second switch, referenced as S2 (described below), is closed. In some embodiments, one or both of these secondary voltage sources may be omitted and replaced with, for example, a direct connection.

The first voltage source V1 in the power supply 100*a* originates the negative voltage for the photocathode, with respect to the input plane of the micro-channel plate (MCP). A first switch, referenced S1, is closed to supply this voltage to the cathode by way of a first resistor, referenced as R1, and a first capacitor, referenced as C1. The first capacitor is coupled in parallel with the first resistor R1. In use, the first switch S1 is closed for a first period of time to charge the photocathode. The first switch S1 is then opened and a second switch, referenced S2, is closed for a second period of time to remove the negative charge from the photocathode at some point in time following the closure of the first switch S1. The second switch S2 is then re-opened prior to the next closure of the first switch S1.

The timing of the first and second switches S1 and S2 is controlled by a timer/driver circuit, referenced as TDC 102. The TDC 102 can be implemented by various conventional electronic means such as integrated circuits configured as timers and drivers or programmable integrated circuits such as microcontrollers used to produce the required timing signals.

By controlling the first and second periods of time with the TDC 102, the duty factor of the power supply can be regulated, thereby setting the figure of merit (FOM) of the image intensifier. In one embodiment, the TDC actuates switches S1 and S2 to limit the duty factor of the image intensifier to a factory-adjustable upper limit to allow adjustment of the signal-to-noise ratio (SNR) and the figure of merit (FOM) of the image intensifier. The effective photoresponse of the image intensifier becomes the original photoresponse times the duty factor, where the duty factor is expressed as the ratio of the time the photocathode is negative (photocathode on, emitting photocurrent) to the total time of a cycle of the switches. In turn, the SNR and FOM are approximately proportional to the square root of the effective photoresponse. Thus, by adjusting the timing to reduce the duty factor, the SNR and FOM can be adjusted downwards to achieve a desired target value. In one embodiment, the TDC 102 operates with factory-set time periods that remain fixed at all light levels. In another embodiment, the time periods may change in response to the cathode current or in response to the ABC circuit described below, e.g. 1, as a result of changes in the input illumination. In cases where the time periods change, this action is referred to as autogating. In the case of autogating, the FOM is still factory-adjustable by limiting the maximum duty factor to a factory-set value.

Switch S2 behaves as a nonlinear current sink. The first and second switches S1 and S2 can be various switchable elements such as, for example, MOSFETs, bipolar transistors, SCRs, Triacs, or optoisolators. The junction of the first and second switches S1 and S2 can be connected directly to the photocathode of the image intensifier as depicted in power supply 100*e* of FIG. 6 below.

In FIG. 2, the first resistor R1 acts as a bright source protection (BSP) resistor. Resistor R1 has a relatively high value (e.g., on the order of several gigohms, such as 2 to 10 gigohms). The voltage drop caused by photocathode current flowing through the resistor R1 reduces the voltage applied to the photocathode and thereby reduces the accelerating potential between the photocathode 14 and the MCP 20. As increasing light impinges on photocathode 14, increasing cathode current, roughly proportional to light level, flows through resistor R1, thereby decreasing the effective photocathode voltage relative to the MCP input plane due to the resistive voltage drop in resistor R1.

Power supply 100*a* additionally, includes, a first diode (referenced as D1) and a second diode (referenced as D2). The first and second diodes D1 and D2 are coupled in series between the photocathode and the positive terminal of the first voltage source V1. The first capacitor C1, first resistor R1, first diode D1, and second diode D2 function to reduce the peak negative voltage applied to the photocathode the image intensifier is operated in high light conditions. The voltage reduction provides some bright source protection to the tube and may also lower the high light resolution necessary to comply with Government-imposed performance restrictions for export. The relatively-large photocathode current in high light produces a voltage drop across R1 to lower the peak negative voltage on the photocathode. The capacitor, C1, couples the voltage excursions from the switches to the photocathode. To couple most of the peak-to-peak voltage from the switches S1 and S2 to the photocathode, the value of C1 may be selected to be at least several times larger than the capacitance from the photocathode to the input of the MCP in the image intensifier, which is typically on the order of 20 to 50 picofarads, making C1 typically several hundred picofarads. The time constant of the first resistor R1 and the first capacitor C1 may be long compared to the switching period of the first switch S1 and the second switch S2. The R1-C1 time constant may be on the order of a second or more, whereas the switch cycle period is typically less than a few tens of milliseconds (e.g., to avoid visible flicker and other undesirable stroboscopic effects), but not so short as to cause excessive power consumption in doing the switching or as to cause excessive average photocurrent which may wash out the image in non-autogated applications). In contrast to the cycle time, the switch closure times for S1 and S2 can be relatively short. The switches stay closed only long enough to bring the switch output voltage close to the switch input voltage. For some switches, this can be accomplished in less than a microsecond, but it may be desirable to deliberately reduce the switching edge rates at the photocathode to minimize radiated emissions. In relatively high light conditions such as 0.01 footcandles to 20 footcandles or more on the photocathode, the voltage on the photocathode continues pulsing, but becomes generally less negative (more positive), due to the voltage drop across the first resistor R1.

Diode D2 may be a Zener diode and diode D1 may be a conventional diode. The Zener diode D2 in conjunction with diode D1 function to clamp the positive peak voltage excursions on the photocathode to an upper limit to assure that the negative excursions are negative with respect to the MCP input plane in order to provide for some photoemission in high light to keep the tube active and producing useful imagery. When the input light becomes sufficiently high, the photocurrent becomes large enough to fully discharge the negative potential on the photocathode prior to the closure of the second switch S2. In this case, the effective duty cycle becomes further reduced to protect the photocathode and the input plane of the MCP, as well as to prevent image washout that could occur due to excessive photocurrent into the MCP. Thus, the power supply can supply useful imagery and photocathode protection in high-light conditions, even though the power supply may not be autogated.

The second and third voltage sources, V2 and V3, are the sources for the MCP and phosphor screen voltages, respectively, as are conventionally used in power supplies for image intensifiers. An automatic brightness control, referenced as ABC, may be employed. Automatic brightness control ABC may be used to monitor the phosphor screen current and causes the second voltage source V2 to reduce its voltage level once the phosphor screen current begins exceeding a preset value. The reduction in the voltage supplied by the second voltage source V2 causes lower electron gain in the MCP in order to avoid excessive output brightness from the phosphor screen in moderate to high light conditions.

Figure 3:
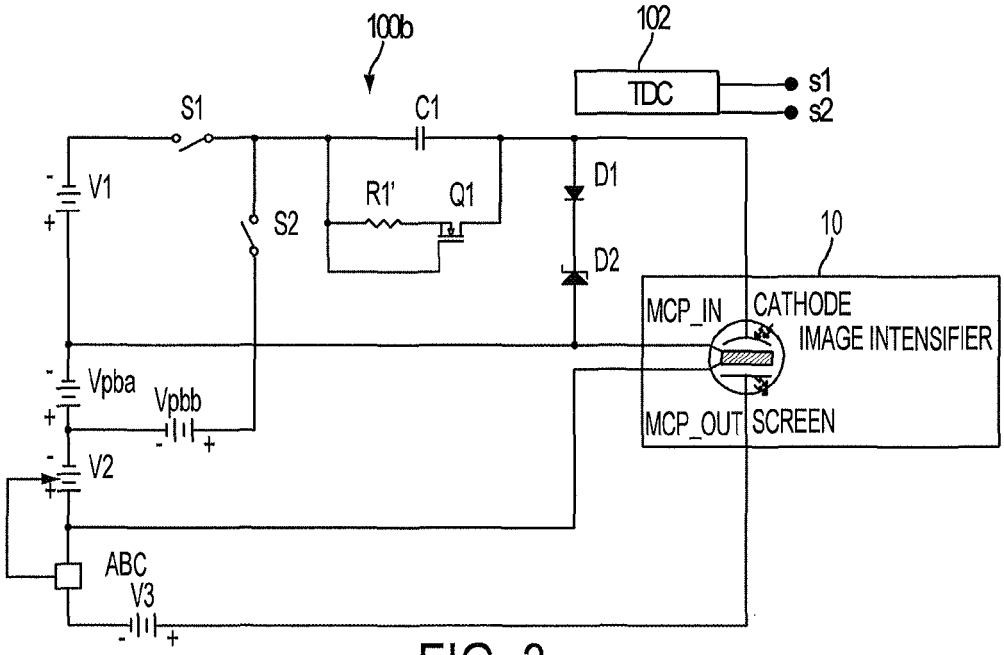
FIG. 3 depicts another power supply for use with an image intensifier in accordance with aspects of the present invention.

FIG. 3 depicts an alternative power supply 100*b* similar to power supply 100*a*. In power supply 100*b*, the bright source protection resistor, R1, of power supply 100*a* is replaced with a constant current sink including a depletion-mode MOSFET, referenced as Q1, in series with a relative low resistance resistor, referenced as R1', having lower resistance than resistor R1 of power supply 100*a*. The value of R1' may be set to produce the desired current through the MOSFET, and the R1' value is typically on the order of 10 megohms. Power supply 100*b* provides a more rapid means of re-charging the photocathode to its negative peak potential following a transition from high light to low light, so that the image intensifier 22 can return to high gain more rapidly than would be provided by the asymptotic re-charge provided by the first resistor R1 in FIG. 1. Power supply 100*a*, charging the photocathode through first resistor R1, requires a longer period of time (e.g., three time constants to reach 99% of the final voltage) to fully charge the photocathode than power supply 100*b*, charging the photocathode through resistor R1' and depletion-mode MOSFET Q1, which charges the photocathode in a linear ramp in one-third the time if set for the same initial current.

Figure 4:
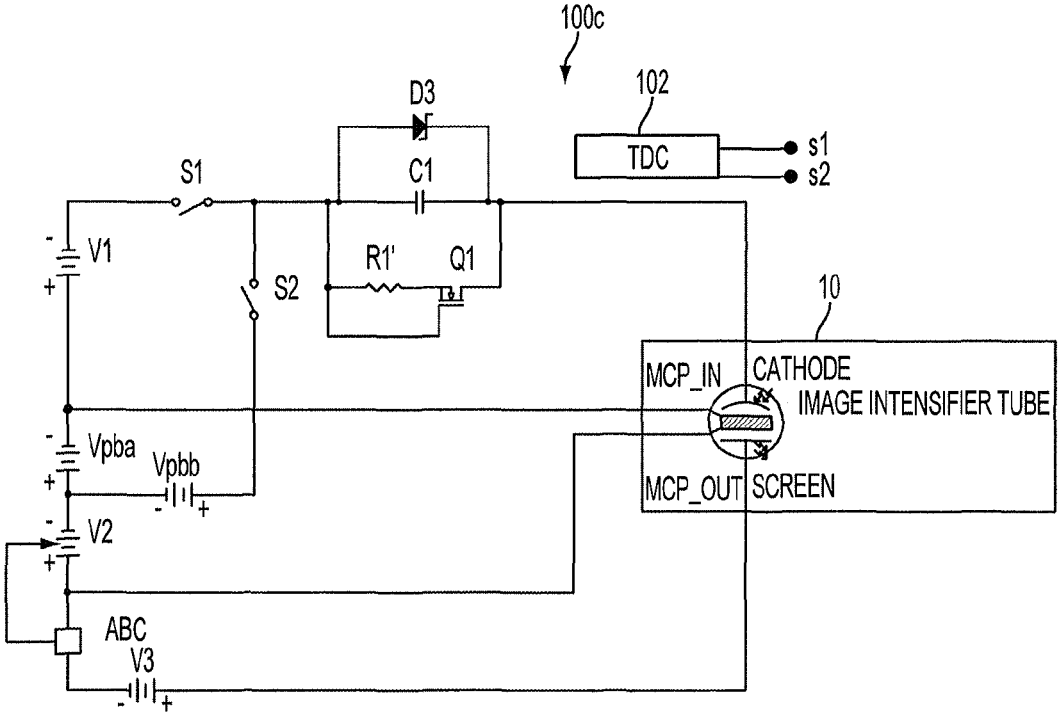
FIG. 4 depicts another power supply for use with an image intensifier in accordance with aspects of the present invention.

FIG. 4 depicts another power supply 100*c* similar to power supply 100*b*. In power supply 100*c*, a Zener diode, referenced as D3, is provided for clamping voltage on the photocathode, rather than diodes D1 and D2 in power supply 100*b*. The Zener diode D3 is connected in series across the resistor R1' and transistor Q1. In this embodiment, the resistor R1' and transistor Q1 form a bright source protection circuit, but it is understood that the resistor R1 (FIG. 2) could replace these components. The Zener diode D3 limits the maximum voltage drop across the constant current source so that the negative excursions of the waveform at the photocathode remain negative with respect to the MCP input plane to keep the image intensifier active and producing useful imagery in high light conditions. It is also understood that while a Zener diode voltage clamp is shown, other voltage clamping circuits could be substituted.

Figure 5:
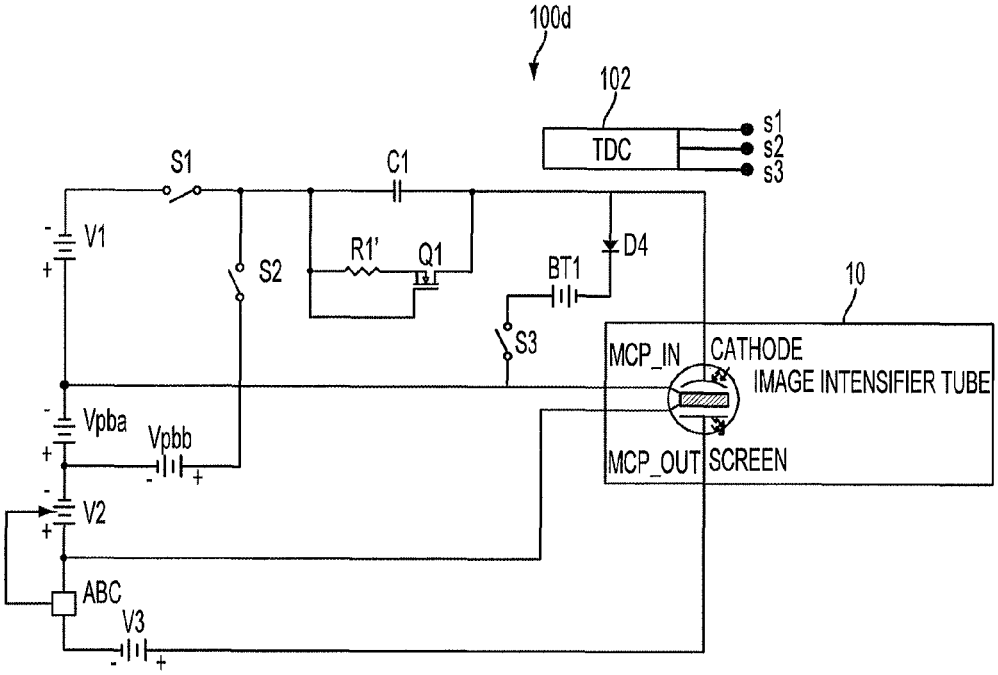
FIG. 5 depicts another power supply for use with an image intensifier in accordance with aspects of the present invention.

FIG. 5 depicts another embodiment of a power supply 100*d*. In power supplies 100*a-c*, peak negative voltage on the photocathode in high light is determined by the peak negative voltage in the photocathode in low light, less the clamping voltage. In the power supply 100*d* of FIG. 5, the peak negative voltage in high light is independent of the peak negative voltage in low light, so that the two can be independently adjusted, if desired. The peak negative voltage in high light is determined by the value of a fourth voltage source, referenced as BT1, less a small forward voltage drop across a diode, referenced as D4, coupled in series with the diode D4. The fourth voltage source BT1 and the diode D4 are coupled to a positive terminal of the first voltage source V1 by a third switch, referenced as S3. The third switch S3 may be controlled by TDC 102.

In use, a negative voltage may be applied by closing the first and third switches, S1 and S3. The peak negative voltage on the photocathode is determined by the larger of the fourth voltage source BT1 switched in using the third switch S3 and the combination of the first voltage source V1 switched in using the first switch S1 less the voltage drop across the capacitor C1. In one embodiment, the first and third switches, S1 and S3, are closed and opened at least substantially simultaneously to produce the negative pulse, though perfect simultaneity is not necessary for proper operation. Since diode D4, the fourth voltage source BT1, and the third switch S3 are connected in series, they can be arranged in any order. One end of the series combination is shown tied to the MCP input plane, but this end could also be tied to the positive end of Vpba or Vpbb, for example, to implement the switch control/drive function. In this case, the fourth voltage source BT1 would have substantially more voltage than either Vpba or Vpbb to assure the net negative peak voltage on the photocathode.

Figure 6:
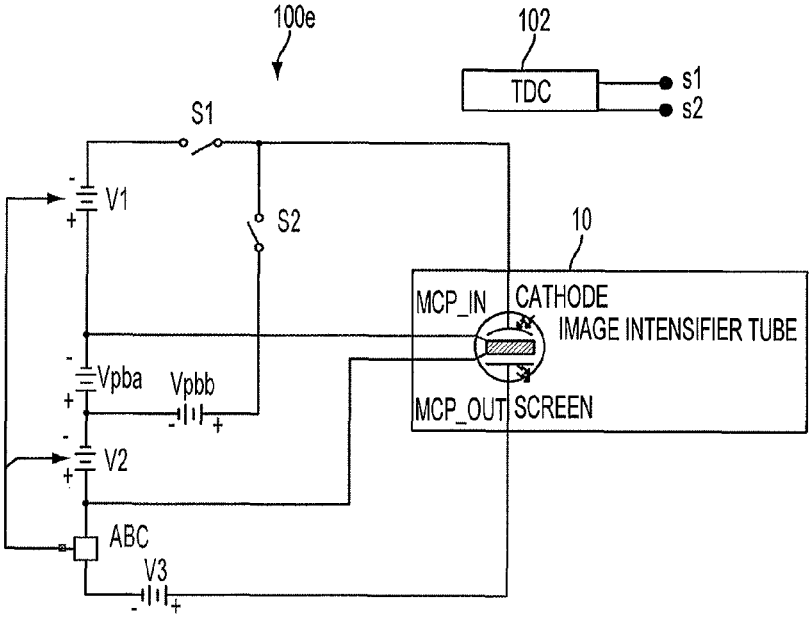
FIG. 6 depicts another power supply for use with an image intensifier in accordance with aspects of the present invention.

FIG. 6 depicts another embodiment of a power source 100*e*. Instead of using the bright source protection elements depicted in FIGS. 2-5, bright source protection is provided in power source 100*e* by actively controlling the magnitude of the first voltage source V1 and second voltage source V2 under control of the automatic brightness control ABC. The voltage magnitude of the first voltage source V1 can be directly controlled, or the first voltage source can remain fixed and the voltage level may be varied by a post-regulator (not shown).

As the ambient light increases from a low value, the automatic brightness control ABC may reduce the magnitude of the second voltage source V2, to reduce gain while also maintaining favorable SNR for good imagery. When the ambient light approaches the high-light region, and there is plenty of signal such that SNR is no longer a limiting factor for image quality, the automatic brightness control ABC may begin decreasing the magnitude of the first voltage source V1 instead of, or along with, further reductions in the second voltage source V2. Once the magnitude of the first voltage source V1 reaches a minimum value determined to maintain the required high-light resolution of the image intensifier 22, then the automatic brightness control ABC ceases further reduction of the first voltage source V1 and returns to reducing the second voltage source V2 to avoid excessive output brightness. Alternatively, the first voltage source V1 can be controlled by a separate control circuit that senses the photocathode current. In either case, when the ambient light becomes sufficiently high, the average photocathode current is limited by the periodic re-charges of the photocathode capacitance by the first switch S1, provided the first switch S1 is only closed for brief periods as was discussed earlier. The maximum average photocathode current is V times C times F, where V is the peak negative voltage applied to the photocathode, C is the capacitance of the photocathode plus the stray capacitance of the switches and connections, and F is the frequency of the brief closures of the first switch S1.

Figure 7:
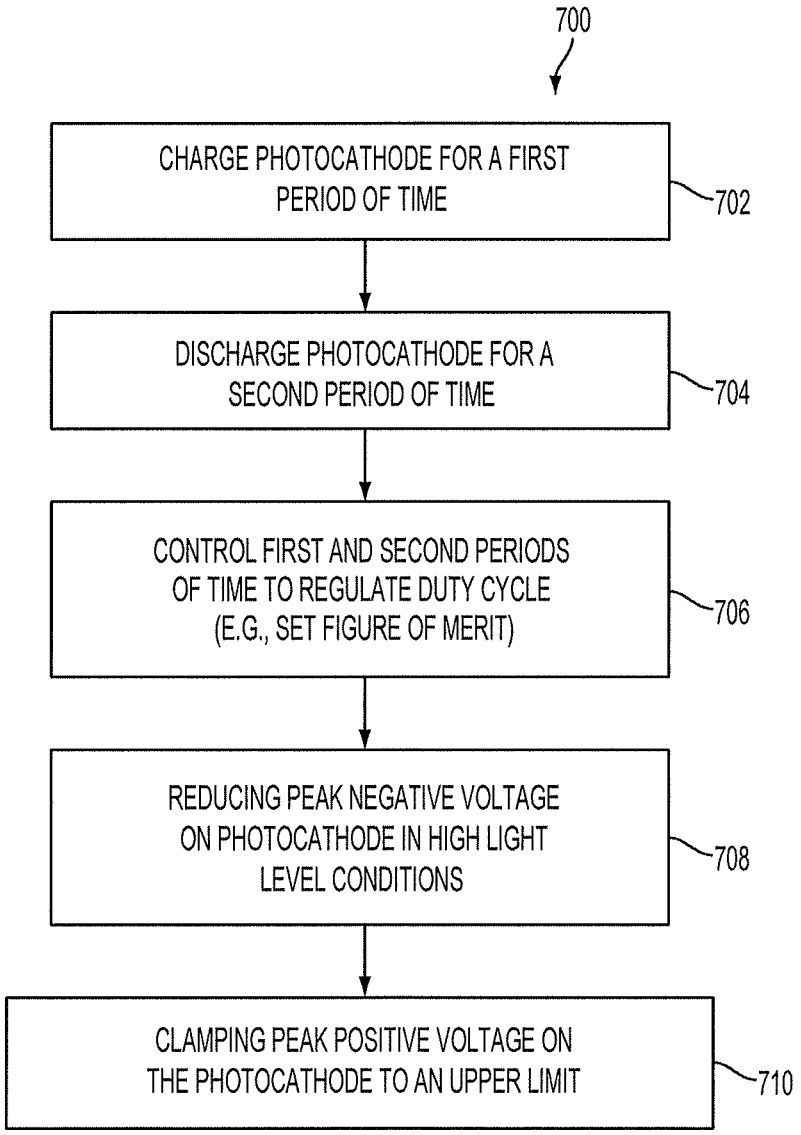
FIG. 7 depicts a flow chart of steps for controlling an image intensifier to regulate performance in accordance with aspect of the present invention.

FIG. 7 depicts a flow chart 700 of steps for controlling a power supply to regulate an image intensifier in accordance with aspects of the present invention. The steps of flow chart 700 are described below with reference to the power supplied 100*a-e* depicted in FIGS. 2-6. Alternative power supplies for implementing the steps of flow chart 700 will be understood by one of skill in the art from the description herein. Additionally, one or more steps of flow chart 700 may be omitted and/or steps may be performed in a different order or substantially simultaneously with respect to other steps without departing from the spirit and scope of the present invention.

In step 702, the photocathode of an image intensifier is charged for a first period of time. In one embodiment, a first switch S1 (and optionally a third switch S3) is closed for a first period of time to couple a first voltage source V1 (and optionally a fourth voltage source BT1) to the photocathode of image intensifier 22 to charge the photocathode. Switch S1 (and optionally switch S3) are opened after the first period of time.

In step 704, the photocathode of the image intensifier is discharged for a second period of time. In one embodiment, a second switch S2 is closed for a second period of time to discharge the photocathode of the image intensifier 22. Switch S2 is opened after the second period of time.

In step 706, the first and second time periods are controlled to regulate the duty cycle of the image intensifier. In one embodiment, the TDC 102 controls the first and second switches S1 and S2 (and optionally the third switch) for the first and second periods of time, respectively, to regulate the duty cycle of the image intensifier 22, which sets the figure of merit (FOM) for the image intensifier.

In step 708, peak negative voltage on a photocathode of an image intensifier is reduced in high light level conditions. In one embodiment, the peak negative voltage may be reduced using the techniques described above with reference to FIGS. 2-6. In step 710, peak positive voltage on the photocathode is clamped to an upper limit. In one embodiment, the peak positive voltage may be clamped using the techniques described above with reference to FIG. 2.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A power supply comprising:

a first voltage source;

a second voltage source coupled in series with the first voltage source;

a switching mechanism, comprising:

a first switch coupled between a negative terminal of the first voltage source and the photocathode;

a second switch coupled to between the photocathode and a negative terminal of the second voltage source;

a bright source protection (BSP) resistor coupled between a photocathode of an image intensifier and the first switch;

a constant current sink coupled in series between the BSP resistor and the photocathode; and a control circuit coupled to the first and second switches, the control circuit controlling the first and second switches to regulate a duty factor of the image intensifier.

2. The power supply of claim 1, further comprising:

a diode clamp coupled between the photocathode and a positive terminal of the first voltage source in parallel with the first voltage source, the first switch, and the BSP resistor.

3. The power supply of claim 1, wherein the constant current sink is a depletion-mode metal oxide semiconductor field effect transistor (MOSFET).

4. The power supply of claim 1, further comprising:

a voltage clamping circuit coupled in parallel with the constant current sink and the BSP resistor.

5. The power supply of claim 1, further comprising:

a fourth voltage source having a negative terminal coupled to the photocathode; and a third switch coupled between the positive terminal of the first voltage source and a positive terminal of the fourth voltage source.

6. A power supply that regulates the performance of an image intensifier having a photocathode, a micro-channel plate, and a phosphor screen, the power supply comprising:

a fourth voltage source having a negative terminal and a positive terminal;

a third switch coupled between the positive terminal of the fourth voltage source and the positive terminal of a first voltage source;

a diode coupled between the third switch and the photocathode;

a second voltage source having a negative terminal and a positive terminal, the negative terminal of the second voltage source coupled to the positive terminal of the first voltage source;

a third voltage source having a negative terminal and a positive terminal, the negative terminal of the third voltage source coupled to the positive terminal of the second voltage source and the positive terminal of the third voltage source coupled to the phosphor screen;

a first switch coupled between the negative terminal of the first voltage source and the photocathode, the first switch coupling the first voltage source to the photocathode to charge the photocathode when closed and disconnecting the first voltage source from the photocathode when open;

a second switch coupled between the negative terminal of the second voltage source and the photocathode, the second switch coupling the photocathode to the second voltage source when closed to discharge the photocathode and disconnecting the photocathode from the second voltage source when open; and a control circuit coupled to the first and second switches, the control circuit controlling the first and second switches to regulate a duty factor of the image intensifier.

7. The power supply of claim 6, wherein the control circuit sets the figure of merit (FOM) for the image intensifier by regulating the duty cycle.

8. The power supply of claim 6, further comprising:

the fourth voltage source having a negative terminal coupled to the photocathode; and the third switch coupled between the positive terminal of the first voltage source and a positive terminal of the fourth voltage source;

wherein the control circuit if further coupled to the third switch and is configured to simultaneously actuate the first and the third switch.

9. A method of regulating performance of an image intensifier having a photocathode, the method comprising steps of:

charging the photocathode for a first period of time;

discharging the photocathode for a second period of time;

controlling the first and second periods of time to regulate a duty factor of the image intensifier;

reducing a peak negative voltage on the photocathode when the image intensifier is operated in high light level conditions; and recharging the photocathode through a constant current sink.

10. The method of claim 9, wherein the controlling step includes setting figure of merit (FOM) for the image intensifier by regulating the duty factor.

11. The method of claim 9, wherein the image intensifier further has a first voltage source, a second voltage source coupled in series with the first voltage source, a first switch coupled between a negative terminal of the first voltage source and the photocathode, a second switch coupled between a negative terminal of the second voltage source and the photocathode; and wherein the controlling step comprises:

controlling the first and second switches to regulate the duty factor of the image intensifier.

12. The method of claim 9, further comprising:

clamping a peak positive voltage on the photocathode to an upper limit to provide some photoemission in the high light level conditions.

13. The method of claim 9, wherein the constant current sink is a depletion-mode metal oxide semiconductor field effect transistor (MOSFET).

14. The method of claim 9, further comprising:

assuring that negative excursions of a waveform at the photocathode remains negative with respect to a micro-channel plate input of the image intensifier.

15. The method of claim 11, wherein the image intensifier further has a third voltage source and a third switch coupled in series the photocathode and a positive terminal of the first voltage source, and wherein the controlling step comprises:

controlling the third switch substantially simultaneously with the first switch.

* * * * *